US005555904A

United States Patent [19]

Stockwell

[11] Patent Number: 5,555,904

[45] Date of Patent: Sep. 17, 1996

[54] FOREARM CRUTCH

[76] Inventor: Walter E. Stockwell, 9252 So. Park, Tacoma, Wash. 98444

[21] Appl. No.: 580,894

[22] Filed: Dec. 29, 1995

[51] Int. Cl.[6] ..... A61H 3/02

[52] U.S. Cl. ..... 135/68; 135/71; 135/72

[58] Field of Search ..... 135/68, 69, 71, 135/72, 66, 76

[56] References Cited

U.S. PATENT DOCUMENTS

| | | | |
|---|---|---|---|
| 577,054 | 2/1897 | Monaghan . | |
| 870,676 | 11/1907 | Hayden . | |
| 1,244,249 | 10/1917 | Schlick . | |
| 2,817,348 | 12/1957 | Holliday, Jr. | 135/72 X |
| 2,989,114 | 6/1961 | Escroyd . | |
| 4,141,375 | 2/1979 | Tykwinski . | |
| 4,237,915 | 12/1980 | Zabielski . | |
| 4,248,256 | 2/1981 | Thomas | 135/71 X |
| 4,295,483 | 10/1981 | Smith . | |
| 4,721,125 | 1/1988 | Wang-Lee | 135/68 X |
| 4,733,682 | 3/1988 | Ellena | 135/68 X |
| 4,850,383 | 7/1989 | McBride . | |
| 4,865,065 | 9/1989 | Chen | 135/68 X |
| 4,917,126 | 4/1990 | Ellmore | 135/69 |
| 5,038,811 | 8/1991 | Gilmore . | |
| 5,178,595 | 1/1993 | MacGregor . | |
| 5,224,717 | 7/1993 | Lowen . | |
| 5,331,989 | 7/1994 | Stephens . | |
| 5,427,131 | 6/1995 | Eggers . | |

*Primary Examiner*—Lanna Mai
*Attorney, Agent, or Firm*—James F. Leggett

[57] ABSTRACT

A set of crutches, having tubular aluminum construction with a Y-type lower support means, which extend upward to elbow height, being adjustable in height, and having an extended horizontal top surface, of sufficient length to accommodate the distance between the largest portion of the forearm and hand of the user, having at its rear an energy absorbing pad to communicate with the user's forearm, being incorporated into an adjustable collar for the forearm, a padded horizontal arm rest extending forward from the adjustable collar, and having a padded vertical hand-hold to function as a hand-rest, to enable the weight of the user to be supported by the forearms and not the hands so that the crutches are usable by an individual who has lost hand strength due to arthritis or other degenerative process, and being equipped with a storage pouch suspended from within the frame of the crutches by Velcro means.

6 Claims, 1 Drawing Sheet

FOREARM CRUTCH

FIELD OF THE INVENTION

This invention relates generally to the area of devices to assist ambulation of individuals, who are unable to continuously support their weight with their legs, and in particular to an improved crutch design to enable individuals, without putting weight on hands or armpits, to utilize crutches for ambulation.

DESCRIPTION OF PRIOR ART

Traditional Y-type crutches have been known for over a century as a useful walking aid for individuals who have lost the ability to ambulate on their own. This type of crutch, while allowing the majority of the weight of the user to be born by the shoulders, requires the user to have sufficient hand strength to grip the handles of the crutch and maneuver it while supporting some of the user's weight with the hands. Thus, someone who had lost the strength or grip in their hands, due to arthritis or other process, was unable to utilize crutches for ambulation with their relative freedom of movement. The first effort to reduce the weight-bearing role of the hands when utilizing crutches was by E. E. Hayden, U.S. Pat. No. 870,676, which combined a standard handhold with an arm-rest or brace. The Hayden patent did not eliminate the need for hand strength to maneuver the crutch or support part of the body weight of the user. An alternative design was disclosed by E. Schlick in U.S. Pat. No. 1,244,249, but still did not totally relieve the hand and wrist from its roll in maneuvering the crutch and supporting, at least, part of the body weight of the user. The need for totally removing the dependance upon hand strength to support and maneuver a walking aid was first recognized by A. E. Lowen in U.S. Pat. No. 5,224,717 with an improved design for a wheeled walker. The wheeled walker does not provide the mobility nor freedom to the user that is provided by the subject invention, the Forearm Crutch.

Therefore, the primary object of this invention is to provide people, who do not have sufficient strength in their hands and/or wrists to utilize standard Y-type crutches, a substitute means therefore, having the same maneuverability and freedom for the user, whereby the user's weight is born by the forearm and the weight of the device when maneuvered is borne by the forearm of the user.

SUMMARY OF THE INVENTION

The foregoing objectives are satisfied by this invention, which is comprised of a modified Y-type crutch, preferably of ¾ inch tubular aluminum construction, having a single tubular aluminum leg with standard rubber crutch foot means at the bottom and cap means at the top, to which a 'Y' frame is attached by standard bolt means through holes regularly spaced along the length of the tubular aluminum leg, thereby allowing the height of the elbow crutch to be adjusted to slightly above the height of the user's elbows above the ground when the user is standing upright, and the 'Y' frame being closed at the top by a tubular aluminum cross tube, the rear of which is provided with regularly spaced holes to accommodate the adjustable attachment of a forearm support means so that the span of the top of the 'Y' frame can be adjusted to the length of the user's forearm, the forearm support, in addition to cushioning the weight of the forearm on the 'Y' frame, has an adjustable collar which encircles the forearm of the user, thus allowing the user to lift and maneuver the Forearm Crutch without weight being borne by the hands, although the end of the cross tube opposite to the forearm support communicates with a vertical section of tubing which forms a hand grip which is covered by suitable energy absorbing material, such as a bicycle handle bar grip, and having a carrying bag of suitable water proof material, suspended from the top and sides of the 'Y' frame by standard Velcro means.

DESCRIPTION OF THE PREFERRED EMBODIMENTS

Figure 1:
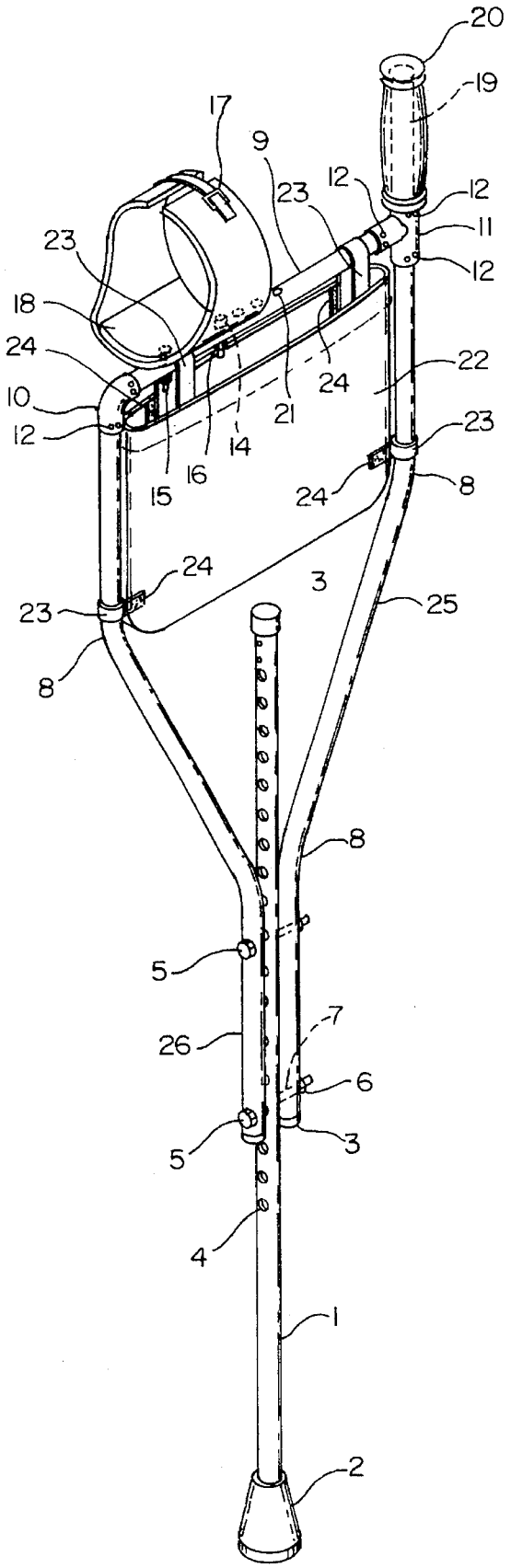
FIG. 1 is a side perspective view of one embodiment of my invention.

With reference FIG. 1, the preferred embodiment of the Forearm Crutch invention is there shown and comprises a tubular aluminum leg (1), having a standard rubber crutch foot (2) at its bottom and standard aluminum tube cap (3) at its top, preferably ¾ inch in diameter and being of sufficient length to support a 'Y' Frame (25) so that the cross tube (9) at its top is slightly above the level of the elbows of the user, the fine height adjustment being accomplished by engaging the stem (26) of the 'Y' Frame (25), by standard bolt means (5) and standard nut means, to the tubular aluminum leg (1), by aligning the through holes (7) in the tubular aluminum stem (26) of the 'Y' Frame (25) with two of the regularly spaced through holes (4) in the tubular aluminum leg (1), a 'Y' Frame (25) formed of tubular aluminum construction with two identical sides, bending (8) away from the stem of the 'Y' Frame (26), which communicates with the tubular aluminum leg (1), the maximum foreseen length of a forearm of a possible user then reverse bending (8) to parallel the tubular aluminum leg (1) a sufficient distance to reach the elbow height of the user, said reverse bends (8) being formed by standard mechanical means, a cross tube (9) spanning the distance between the open ends of the 'Y' Frame (25) and communicating with and fixedly attached by standard pop rivet means (12) to a standard elbow fitting (10) at the rear of the 'Y' Frame (25) and to a standard 'T' fitting (11) at the front of the 'Y' Frame (25), the third leg of the 'T' fitting (11) connecting by standard pop rivet means (12) to an aluminum tubing hand grip (19) which extends upward from the 'Y' Frame (25) and is covered with energy absorbing material (20) to accommodate the hand of the user, a forearm support (13), made of suitable smooth, energy absorbing material, such as standard P.V.C. pipe, of sufficient diameter to accommodate the user's forearm, being adjustable in diameter by standard strap and buckle means (17), and having the top-rear half of the forearm support (13) cut away so as to readily accommodate the elbow and upper arm of the user, the inside of said forearm support (13) being provided with a removable, washable cushion (18) of suitable material, such as soft rubber, and said forearm support (13) being adjustably affixed to the top of the cross tube (9) by two standard bolt means (15) which communicate from the forearm support (13) through spacers (14), to maintain the proper distance of the forearm support above the cross tube (9), and through regularly spaced through holes (21) in the cross tube (9), and removably secured by standard nut means (16).

The preferred embodiment of my invention includes a carrying bag (22) of suitable water proof material suspended from the cross tube (9) and the 'Y' Frame (25) by fabric strips (23) and fastened to the carrying bag (22) by standard Velcro means (24).

Although particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A crutch capable of being used by a person in full upright position so that weight is borne by the forearm and the crutch is maneuvered by the forearm and hand, comprised of:

an adjustable length leg means, a 'Y' Frame means consisting of two identical sides which have a stem of the 'Y' at the bottom, which adjustably communicate with the leg means, so as to adjust the over-all height of the crutch, and which side bends away from the stem a sufficient distance tp accommodate ½ the longest length of a user's forearm, then reverse bends to parallel the leg means and extend to just above the user's elbow, and a cross tube connected to the top of two sides by pop rivet means through an elbow fitting in the rear and a 'T' fitting on the front, the leg of the 'T' fitting opposite to the side, connecting by pop rivet means with a handgrip means, a forearm support means being adjustably mounted along the length of the cross tube by suitable attachment means and adjustable in diameter by strap and buckle means.

2. A crutch of claim 1 wherein the adjustable length leg means being comprised of a section of ¾ inch tubular aluminum of suitable length, having a rubber crutch foot at its base and an aluminum cap at its other end, and having regularly spaced through holes along its length to accommodate a bolt and nut means for attaching the stem of the 'Y' Frame.

3. A crutch of claim 1 wherein the 'Y' frame means being comprised of ¾ inch diameter aluminum tubing, the bottom of which is sealed with aluminum tube caps, and having through holes in the tubular aluminum stem of the 'Y' Frame to accommodate a bolt means to adjustably connect the stem of the two sides to the leg means and being secured by nut means.

4. A crutch of claim 1 wherein the handgrip means being comprised of a ¾ inch diameter aluminum tube, of suitable length to accommodate a hand of a user, fixedly attached, vertically, to the 'T' fitting by pop rivet means, its top end sealed with an aluminum cap, and covered in suitable energy absorption material, such as foam.

5. A crutch of claim 1 wherein the attachment means for adjustably mounting the forearm support to the cross tube, comprising through-holes being regularly spaced along the length of the cross tube to accommodate bolt means from the forearm support though a spacer means, to maintain the appropriate alignment between the forearm rest and the aluminum tubing hand grip, through the cross tube and secured with nut means.

6. A crutch of claim 1 wherein the forearm support means being comprised of a section of suitable energy absorbing material, such as P.V.C. pipe, of adequate length to span the largest diameter portion of a user's forearm, being tubular in shape with the top of the rear portion cut away to readily allow access of the elbow and upper arm, while the front portion contains a means to adjust the diameter of the forearm support, such as a strap and buckle.

* * * * *